US008452467B2

(12) United States Patent
Kumar

(10) Patent No.: US 8,452,467 B2
(45) Date of Patent: May 28, 2013

(54) SYSTEM AND METHOD FOR VERIFYING TRACK DATABASE INFORMATION

(75) Inventor: Ajith Kuttannair Kumar, Erie, PA (US)

(73) Assignee: General Electric Company, Schenectady, NY (US)

( * ) Notice: Subject to any disclaimer, the term of this patent is extended or adjusted under 35 U.S.C. 154(b) by 1215 days.

(21) Appl. No.: 12/208,516

(22) Filed: Sep. 11, 2008

(65) Prior Publication Data

US 2010/0063734 A1 Mar. 11, 2010

(51) Int. Cl.

| | |
|---|---|
| ***B61L 25/00*** | (2006.01) |
| ***B61L 99/00*** | (2006.01) |
| ***B61L 3/00*** | (2006.01) |
| ***G05D 1/00*** | (2006.01) |
| ***G06F 17/00*** | (2006.01) |
| ***G01C 21/12*** | (2006.01) |

(52) U.S. Cl.

USPC ..... 701/19; 701/409; 701/450; 701/466; 701/514; 701/523; 246/185; 340/901; 340/905

(58) Field of Classification Search

USPC ..... 701/1, 19, 20, 35, 207, 208, 213, 701/300, 36, 116, 400, 408, 409, 445, 450, 701/466, 514, 518, 521, 523, 532; 246/167, 246/185, 167 R; 340/901, 988, 905, 995.1, 340/995.24

See application file for complete search history.

(56) References Cited

U.S. PATENT DOCUMENTS

| | | | | |
|---|---|---|---|---|
| 5,978,718 | A | 11/1999 | Kull | |
| 6,088,635 | A | 7/2000 | Cox et al. | |
| 6,532,038 | B1 | 3/2003 | Haring et al. | |
| 2009/0105893 | A1 * | 4/2009 | Kernwein | 701/19 |

* cited by examiner

*Primary Examiner* — Thomas Tarcza
*Assistant Examiner* — Edward Pipala
(74) *Attorney, Agent, or Firm* — GE Global Patent Operation

(57) ABSTRACT

The system comprises a track profile database stored in a memory that has data relative to the identity of one or more wayside devices for a track and data relative to a location associated with each of the one or more wayside devices on the track. A camera generates visible spectral data of the wayside equipment as the vehicle travels on the track. A data storage device is provided for storing the spectral data received from the camera and data relative to a location of the powered vehicle when the camera generates the spectral data of the wayside equipment wherein the location of the powered vehicle represents the location of the wayside equipment. A controller is configured to compare the location data of the wayside equipment in the database to the location data associated with the spectral data of the wayside equipment stored in the data storage device.

26 Claims, 4 Drawing Sheets

SYSTEM AND METHOD FOR VERIFYING TRACK DATABASE INFORMATION

BACKGROUND OF THE INVENTION

Embodiments of the invention pertain to databases that are maintained and contain data relating to roadway, waterway, off-road, track and other designated pathway systems that are used for transportation by powered vehicles. More specifically, embodiments of the invention relate to databases that are maintained and contain information concerning railroad track systems.

Railroad companies operate trains and control railroad traffic on track systems that may include thousands of miles of railroad tracks. In order to control the movement of trains on a track system, a track database is maintained that contains information relating to track topography, which is also referred to as the track profile data. The track profile data stored in these databases includes, among other things, grade data, track curvature data, and geographic coordinates of various points or segments of the track. Typically, a railroad track system is divided into geographic subdivisions, which include sets of railroad tracks extending between different train destinations. Within a subdivision, the railroad track may be segmented into track sections (that may include multiple tracks) of a predetermined length; and, for each track section there is provided one or more track grades or ranges of track grades. The track grade data for any one track section may be constant or it may have different grades in a single direction, grades in opposite directions have opposite signs, adjacent parallel tracks can have different grades or compensated grades including banking or super elevation curvature.

Geographic coordinates in the track profile data are typically provided in the form of a location of a point or section of the track and/or the identification of wayside traffic control devices or railroad crossings relative to mileposts (also referred to as "mile markers") or other reference points positioned along the track. For example, a database may show that track T5 has a 1% track grade for 10 miles (16.09 kilometers) from mile post #75 to mile post #85 at which point the grade may increase to 1.1% for the next two miles from mile post #85 to milepost #87. In another example, the database may provide that switch A1 that connects track T5 to track T6 is positioned halfway between milepost #110 and milepost #111. The database may also provide coordinate or location data at discrete points along the track, for example location data relative to a start point, ending point, mile markers, switches, signal locations, etc.

In addition, the track database may include data relative to one or more civil speed limits associated with various track sections. Sometimes the track database may have temporary speed restrictions that may be imposed as a result for example of track repairs taking place on the track.

In use, the track database for a selected track or sections of track on which a train will be traveling is provided to an operator who prepares a trip plan based on the information provided in the track database. The operator, based on past experience and/or operating manuals, maps out a train route over the track sections provided. The route will include the identity of the different tracks the train will travel on and the different speeds at which the train will travel along the track. Given the track grade, and other parameters such as train weight and length, the operator is able to determine the locomotive throttle positions necessary to achieve the different desired speeds on the track, and plans the trip accordingly.

However, at times the data found in these databases is not complete, has not been updated, or is simply incorrect or inaccurate. In addition, locomotives may include one or more operating systems that provide for the automated control of certain locomotive functions. Such systems may include fuel savings systems, positive train control systems, brake control systems, and operator coaching systems, which use elements of the track database for the automated control of certain locomotive operations. The manufacturers or vendors of such systems provide relevant components of the track database; however, data conversion, human error, and other factors may lead to incorrect or inaccurate data entry.

In any such case in which the track grade is not correct the train may be traveling too fast on a track, which may result in an accident or inefficient use of fuel; or, the train may be traveling too slow, which may result in the train not meeting a time schedule. Moreover, if, for example, the data relating to the location of a switch is inaccurate, the train may enter the switch at too high a speed, which could cause an accident or derailment.

BRIEF DESCRIPTION OF THE INVENTION

Embodiments of the invention relate to a system for verifying data in a track database, which is used with a track system including a plurality of tracks on which a powered vehicle travels. The system comprises a track profile database stored in a memory having data relative to the identity of one or more wayside devices for a track and data relative to a location associated with each of the one or more wayside devices on the track. A camera, onboard the vehicle, generates visible spectral data (or other image/spectral data) of the wayside equipment as the vehicle travels on the track. A data storage device is provided for storing the spectral data received from the camera and data relative to a location of the powered vehicle when the camera generates the spectral data of the wayside equipment, wherein the location of the powered vehicle represents the location of the wayside equipment. A controller is provided and configured to compare the location data of the wayside equipment stored in the track database to the location data associated with the spectral data of the wayside equipment stored in the data storage device to verify the accuracy of the wayside device location data in the track database.

A method or computer readable media for verifying data in a track database for a track system, on which a powered vehicle may travel, comprises providing a track profile database stored in a memory. The track profile database has data relative to the identity of one or more wayside devices for a track and data relative to a location associated with each of the one or more wayside devices on the track. In addition, the method comprises generating, onboard the vehicle, visible spectral data of the wayside equipment as the vehicle travels on the track; storing the spectral data received from the camera and data relative to a location of the powered vehicle when the camera generates the spectral data of the wayside equipment wherein the location of the locomotive represents the location of the wayside equipment; and, comparing the location data of the wayside equipment stored in the track database to the location data associated with the spectral data of the wayside equipment stored in the data storage device to verify the accuracy of the wayside device location data in the track database.

BRIEF DESCRIPTION OF THE DRAWINGS

The present invention can be more easily understood and the further advantages and uses thereof more readily apparent, when considered in view of the following detailed description when read in conjunction with the following figures, wherein.

DETAILED DESCRIPTION OF THE INVENTION

Figure 1:
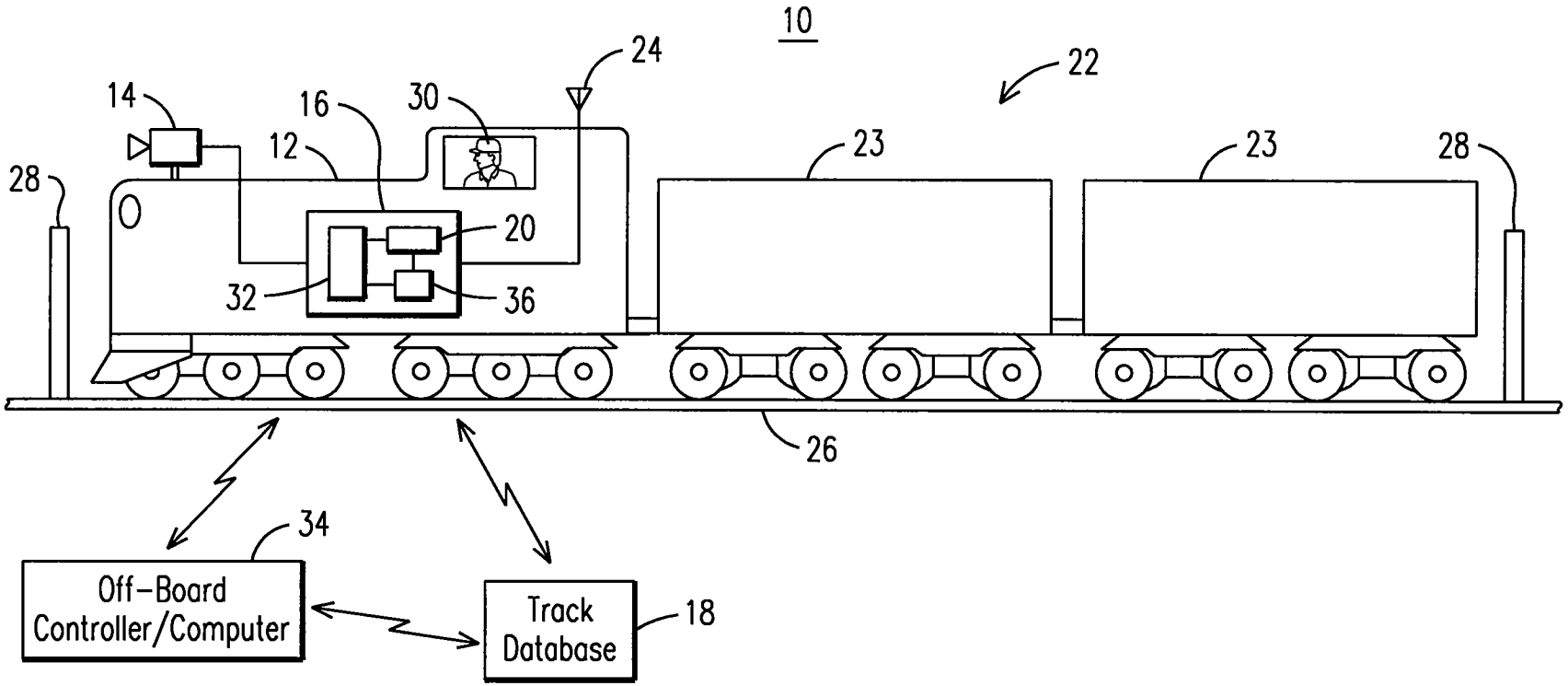
FIG. 1 is a schematic illustration of a data verification system and a locomotive having components of the system, according to an embodiment of the present invention.

A more particular description of the invention briefly described above will be rendered by reference to specific embodiments thereof that are illustrated in the appended drawings. Understanding that these drawings depict only typical embodiments of the invention and are not therefore to be considered to be limiting of its scope, the invention will be described and explained. While the invention is described below in reference to locomotives and trains the invention is not so limited. The invention may be used with other vehicles including marine vessels, off-highway vehicles, on-road vehicles, etc. The term "powered vehicle" as used herein shall comprise the vehicles that have an onboard power source sufficient to propel the vehicle and possibly others in a series of vehicles. In the case of trains traveling on railroad tracks, the locomotive is the powered vehicle. The term "track" as used herein shall comprise different pathways, such as off-road, off-highway, roads, marine pathways, or railroad tracks traveled by powered vehicles. In addition, the terms "geographic coordinates" or "coordinates" comprises one or more track locations or locations of a vehicle on a track. The locations may be characterized or determined in any number of ways, including, but not limited to providing longitudinal, latitudinal or elevational coordinates or providing the distance a point or location is from a fixed reference such as a vehicle start or destination location or a mile marker positioned along the track.

Before describing in detail the particular method and apparatus for verifying track database information in accordance with embodiments of the present invention, it should be observed that the present invention resides primarily in a novel combination of hardware and software elements related to said method and apparatus. Accordingly, the hardware and software elements have been represented by conventional elements in the drawings, showing only those specific details that are pertinent to the present invention, so as not to obscure the disclosure with structural details that will be readily apparent to those skilled in the art having the benefit of the description herein.

Figure 2:
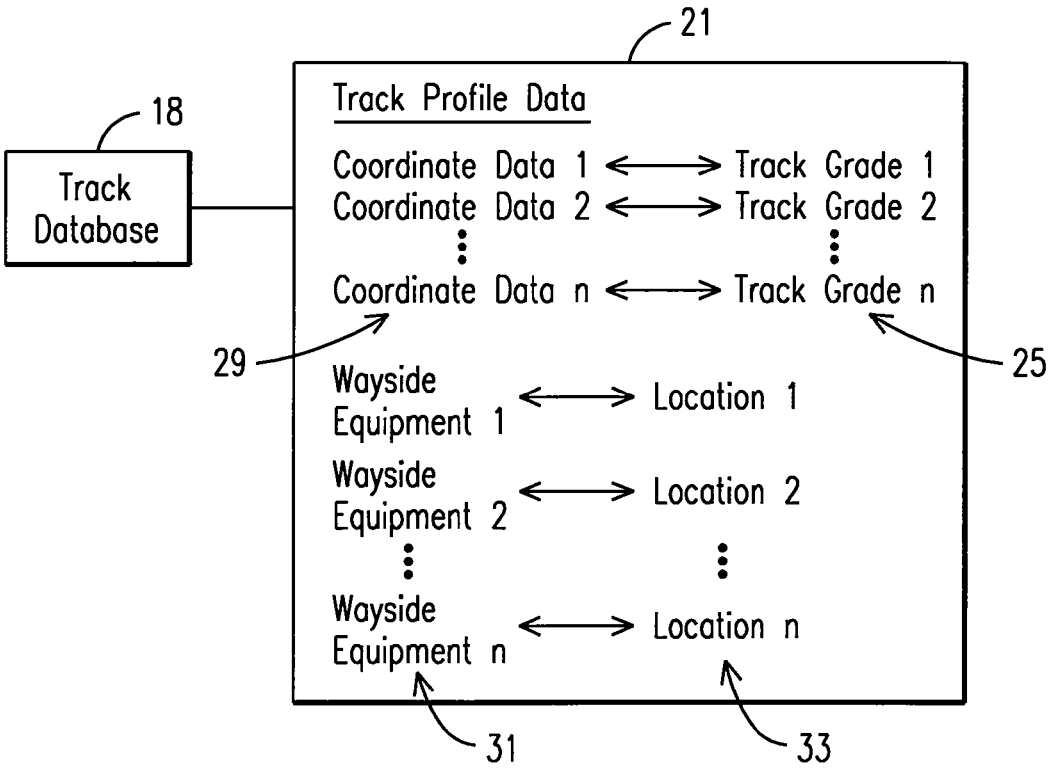
FIG. 2 is a schematic diagram of a track database and relevant data.
Figure 3:
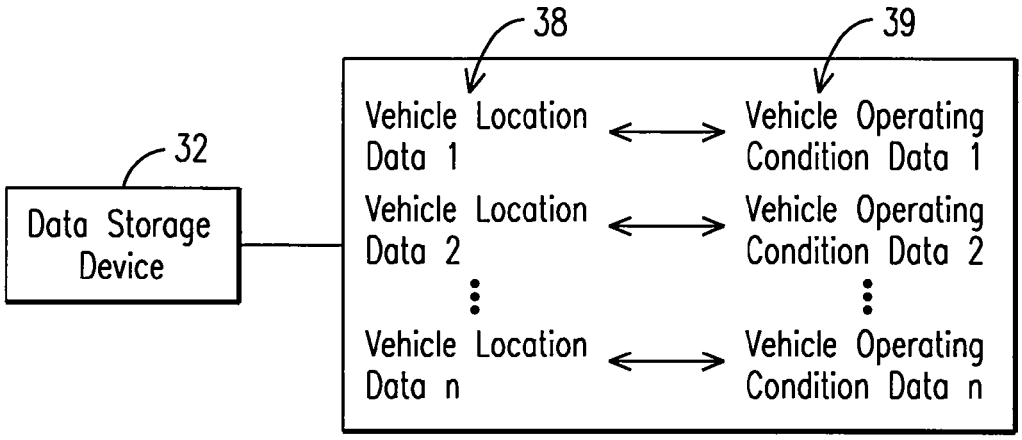
FIG. 3 is a schematic diagram of a data storage device and the relevant data.

With respect FIGS. 1, 2 and 3 there is schematically illustrated an embodiment of the data verification system 10 used in connection with the operation of a locomotive 12 and train 22 that includes a plurality of railcars 23 and travels on a track 26. The locomotive 12 includes an onboard operating system 16 that comprises one or more controllers 20 that are used to control locomotive operations or functions. A global positioning system (GPS) transceiver 24 is provided and transmits data relative to the movement and location of the locomotive 12 to the one or more controllers 20 as the locomotive 12 and train are traveling on the track 26. Alternatively, a controller/processor 36 may be provided and programmed to determine the geographic coordinates by estimating or determining the distance the locomotive 12 has traveled on the track 26 from a fixed reference point such as a wayside device, or a starting location of the locomotive 12. Accordingly, coordinate data may be expressed as a distance that is measured, estimated or inferred by the controller 36 that the locomotive 12 has traveled relative to a known object such as a wayside device, or a starting location of the locomotive 12. Alternatively, the controller may determine the location of the locomotive 12 or train 22 based on a collection of inputs such as GPS, speed sensors, operator inputs or wayside sources, etc.

The track 26 represents a section of railroad track that is a component of a track system that may include thousands of miles or tracks that may be divided into one or more geographic subdivisions. A track database 18 having stored track profile data 21 is provided for planning a trip or route on the track 26. The track profile data 21 comprises data relative to the grade 25 of the track 26 at a plurality of geographic coordinates or locations 29 along the length of the track 26. The coordinate data 29 may be absolute geographic data, such as longitudinal and latitudinal data. Such data 29 may also include track elevation data. The track coordinate data may also be provided as a relative distance or a distance range of a selected location of the track is or has traveled from a fixed reference point. The track grade data 25 and corresponding coordinate data 29 may be provided at any selected increments such as fractions of a mile along the track 26. When the track grade remains constant or fixed, within a predetermined range over an extended distance, the track grade data may be provided for fewer track locations. In addition, the track grade data may be provided at various points of interest along the track including locations where the power settings of the locomotive 12 may be changed due to track grade (other factors such as the weight of the train 22 and a desired speed determined according to a trip plan), or at points where the train may enter or exit the track 26. The track grade data 25 may be provided in the form of a percentage value denoting the rate of change of a rise over a designated length of the track, or track elevation data may be provided and with the controller 36 being configured to estimate the grade as the locomotive 12 travels on the track 26.

Data 21, other than track grade data, may be provided in the track database 18. Other such data may comprise speed limits or restrictions for various sections or segments along the track. The speed restrictions may include speed limits imposed by railroad companies and/or local communities (i.e., civil speed limits) or temporary restrictions that are the result of some event, such as track repair, occurring on the track 26. Other physical characteristics, such as track curvature and/or super elevation associated with the track 26 and the location of the curvatures and/or super elevations, may be included in the database. In addition, the identity and location of wayside traffic control devices such as switches, mileposts, grade crossings, and signal lights may be provided. In addition, there may be other items of interest like wayside detectors, dragging equipment, lubrication equipment, wheel temperatures, etc.

The track database 18 (or components of the track database 18) and a train manifest are provided to a train operator who develops a trip plan, and/or operates the train, according to the data 21 in the track database and the train manifest. More specifically, the train operator has been trained and/or follows operating manuals to determine the throttle settings and/or braking commands (or other vehicle operating conditions) for the locomotive 12 traveling on various sections of the track 26. The train operator primarily considers the track grade, speed restrictions, signal information, and train weight and length to determine the different throttle positions (or locomotive speed or other vehicle operating conditions) for the locomotive during a trip. In addition, the train operator 30 may also verify that one or more controllers 20 have the same data found in the track database 18 and the train manifest.

Figure 4:
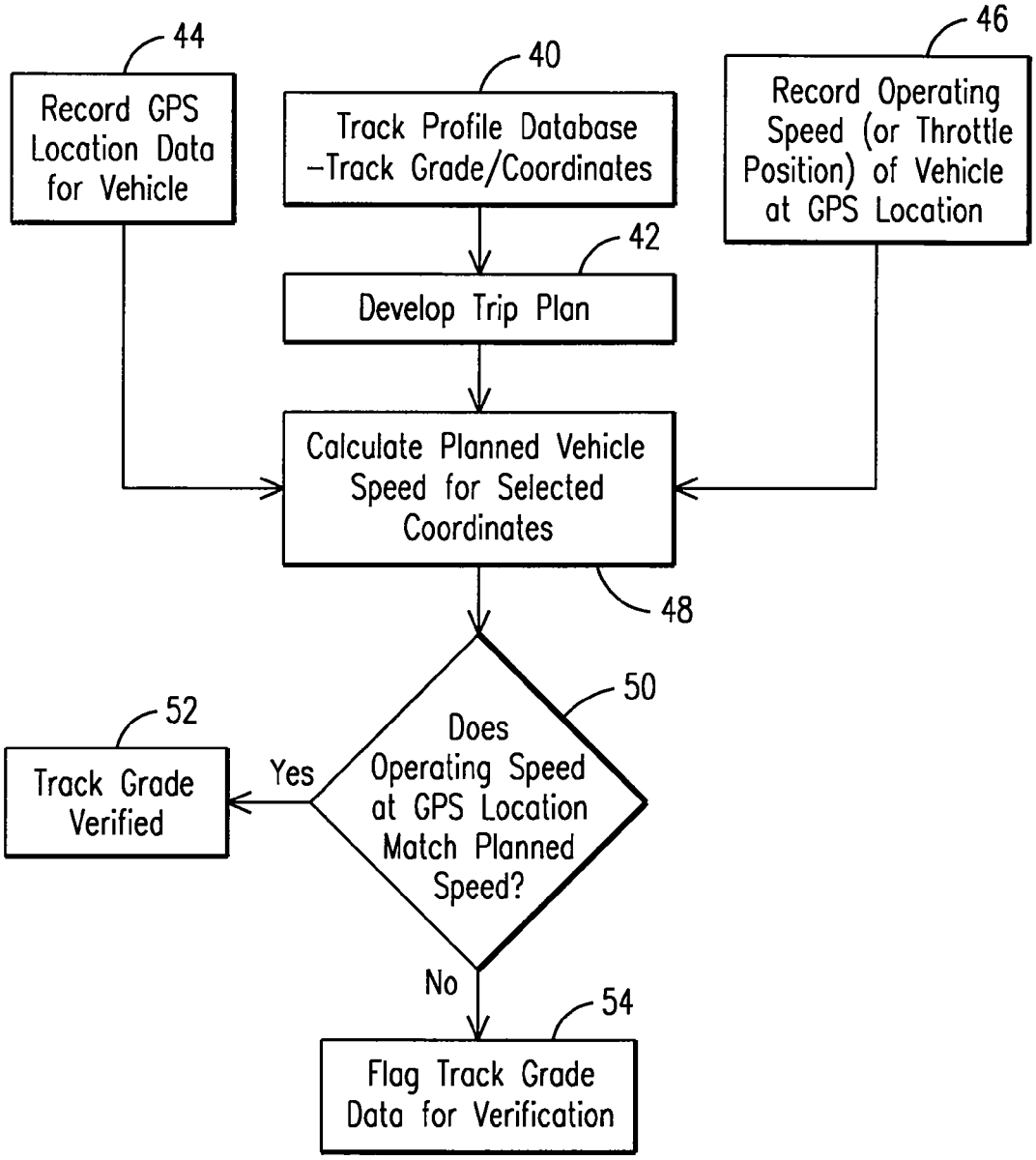
FIG. 4 is a flow chart describing steps in an embodiment of the data verification system and method.

With respect to FIG. 4, in steps 40 and 42 respectively, the track database 18 is provided and the train operator 30 develops a trip plan for the locomotive 12 and train 22. (By "providing," it is meant the initial establishment of the database and/or that the database contents are made available.) As the train 22 is traveling on track 26, the GPS transceiver 24 transmits data 38 relative to the location of the locomotive 22 on the track 16 to a data storage device 32. In addition, the controller 20 transmits data 39 relative to the speed at which the locomotive 12 is traveling on the track to the data storage device 32. (As indicated in FIG. 3, the data 39 may relate to operating conditions of the train or other vehicle other than speed. Such data is collectively referred to as "vehicle operating condition data.") Accordingly, the data storage device 32 has stored data relative to the speed, power and braking at which the locomotive 12 has traveled on the track 26 at various locations on the track 26. In addition, data from a train manifest relating to the physical parameters or characteristics of the train such as its length, weight, etc. may also be considered in determining the speed at which the locomotive 12 should travel on the track 26. This information or data can then be used to verify whether the track grade data in the track database 18 is accurate.

In step 48, using the track grade data 25, the associated notch settings for the different sections of the track 16, and known algorithms, it is possible to calculate a planned speed or other vehicle operating condition for the locomotive 12 to travel on the track 26 according to the trip plan developed by the operator. In addition, other information such has train manifest (weight), desired throttle setting etc. may be considered to calculating the planned speed. In step 50, the recorded operating speed of locomotive 12 is then compared to the planned speed at various sections or points on the track 26 to see if the data matches or is within an acceptable range or within a required accuracy. If the operating speed and planned speed data matches, then the track grade data for a selected section or point of the track 26 in the database 18 may be marked as verified, as at step 52. If the data does not match, then in step 54 the identified location or section of the track 16 and the associated track grade data is flagged for further investigation into the reason for the discrepancy. As noted above, the discrepancy may be due to incorrect track grade data entered in the database 18.

The verification processing may be conducted on an off-board computer or other controller 34, shown in FIG. 1. When the train 22 has completed a trip, a portion of a trip, or has otherwise stopped at a station with an off-board controller 34, the data in the data storage device 32 may be downloaded to the off-board controller 34 for verifying the track grade data. The controller 34 is provided with the track database 18 for processing the verification steps. In addition, or alternatively, operating system 16 may include the controller/processor 36 that is programmed to calculate or access the planned speeds for various locations of the track 26 and compare the operating speed to the planned speed for real time verification. The operating system 16 may include a display screen (not shown) that displays the track grade data provided in the track database 18 and an estimated track grade determined by the controller/processor 36 based on the current operating speed or throttle position of the locomotive 12. Note, data from multiple trains or locomotives may be provided to the controller 34 to further verify the accuracy of the track grade data. Using multiple locomotives as multiple reference points can eliminate or help identify bad data or incorrect data relative to a controller's 36 estimation of the track grade.

Again with respect to FIG. 1, the data verification system may also include a camera 14 mounted on the locomotive 12 for recording images of wayside equipment/devices 28 such as mile markers, switches, grade crossings, operator instructions, light signals, speed limit signs, dragging equipment detectors, lubrication equipment, wheel temperature detectors, etc. The camera 14 may be configured to collect visible spectral data (or other spectral/image data such as thermal imaging cameras) of the wayside equipment 28 as the locomotive 12 travels on the railroad track 26. The camera 14 may be a video camera that runs continuously or that is configured to run periodically at estimated times when the locomotive 12 passes the wayside equipment 28. The camera 14 is linked to the operating system 16 of the locomotive 12 to transmit recorded images to the data storage device 32. The camera 14 may be configured to record date and time information relative to the recorded images. In addition, the GPS transceiver 24, or other location determining equipment, transmits the locomotive 12 coordinate data to the data storage device 32, which data may include date and time information. Alternatively, or in addition, the operating system 16 may be configured to record date and time information as the recorded image and GPS coordinate data is received at the operating system 16. In addition, the operating system 16 may be configured to determine the location of the locomotive 12 in terms of distance the locomotive has travelled and record the data for some predetermined distance intervals, and associate those distances with dates and time, so that a recorded image may be associated with a location of the locomotive 12. In this manner, the recorded image may be matched with the appropriate coordinate data based on the date and time information provided by the camera 14 and/or the GPS transceiver 24. As described above, other methods of determining location of the locomotive 12 on the track 26 may be utilized. For example, the controller 36 may be configured to estimate a distance the locomotive 12 has traveled relative to a fixed reference point such as a starting point or a wayside device 28.

Figure 5:
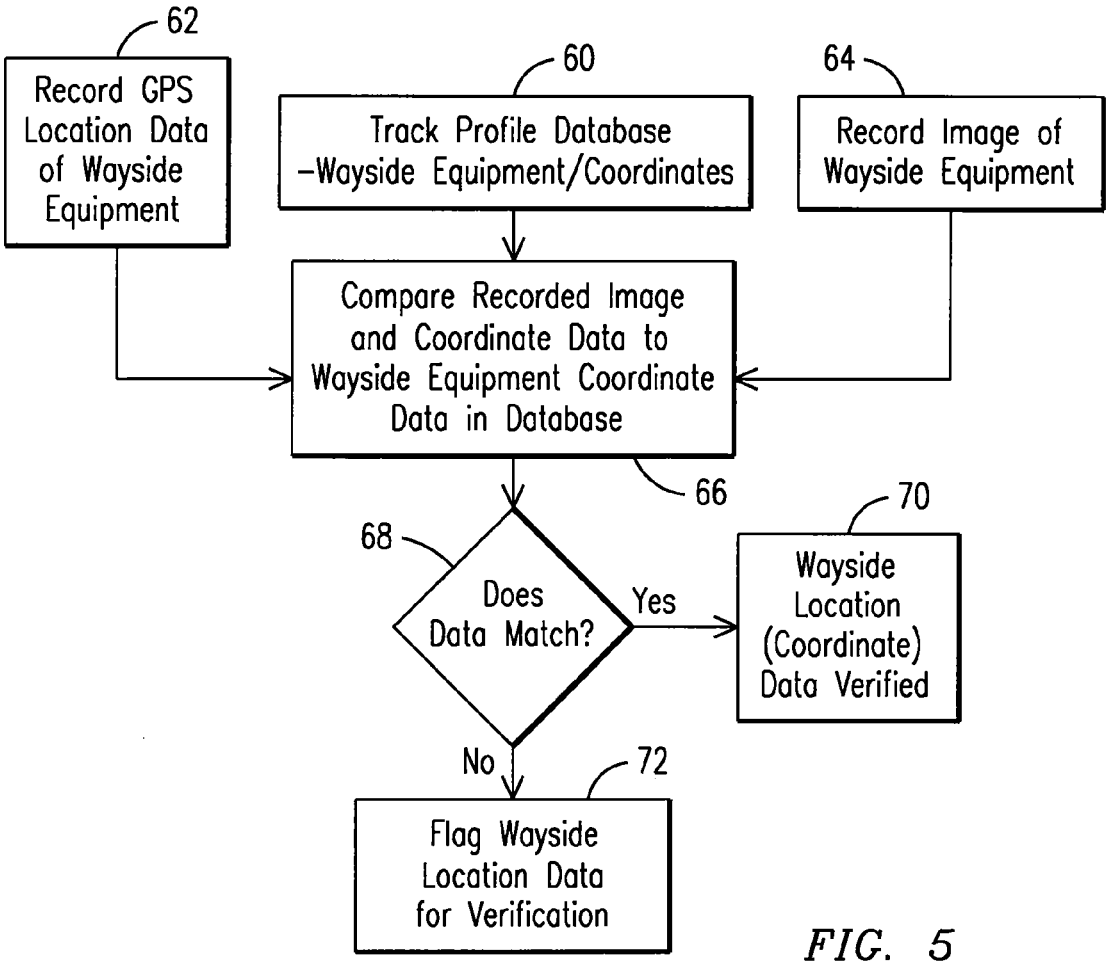
FIG. 5 is a flow chart describing steps of a second embodiment of the data verification system and method.

With respect to FIG. 5, the track database 18 is provided in step 60 and includes track profile data 21 (see FIG. 2) relative to the identity 31 and location 33 of various wayside devices/equipment 28 positioned along the track 26. In steps 62 and 64 respectively, GPS coordinate data relative to the location of the locomotive 12 and one or more images of the wayside equipment 28 is recorded and stored in the data storage device 32. As described above, in lieu of the transceiver 24, the controller/processor 36 or other controllers 20 may determine the location of the locomotive 12 by calculating the distance the locomotive has traveled relative to some fixed reference point, when the image is received at the data storage device 32 from the camera 14.

Figure 6:
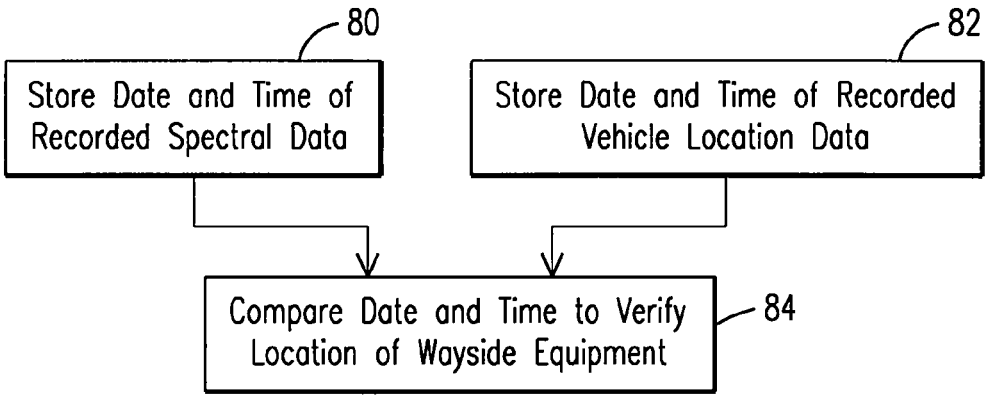
FIG. 6 is a flow chart describing steps in an embodiment of the invention.

In step 66, the wayside equipment coordinate data is compared to the corresponding data 33 stored in the track database 18; and, in steps 68 and 70 if the coordinate data matches, the wayside signal 28 and coordinate data is marked as verified. In steps 68 and 72, if the recorded coordinate data for the wayside equipment 28 does not match, the wayside equipment coordinate data 33 in the track database 18 is flagged for further verification or investigation. As described above, the verification processing may be conducted using an off-board controller 34 or the onboard controller/processor 32 for real time verification. With respect to FIG. 6, an embodiment of the invention may include the step 80 which includes storing data relative to dates and/or time the spectral data is generated and/or recorded. In addition, in step 82, data relative to date and time of the recorded location of the vehicle that is associated with the spectral data is recorded. In step 84 the date and time data information associated with the spectral data is matched with date and time information that is associated a vehicle location to determine or verify the location of the wayside device.

Verifying the location of the wayside equipment is critical to the operation of the locomotive 12 and train 22. The operator 30 makes decisions relative to the speed of the locomotive 12 based on the location of certain wayside equipment 28. For example, if data is provided that signal lights are located five miles ahead of the locomotive 12, and there is a speed restriction associated with signal lights, the operator 30 may need to start decelerating and slowing the locomotive within two miles of the lights in order to see and interpret the signals accordingly.

Processing the data may be conducted by the wayside controller 34 or the operating system 16 may be configured to process the data during the normal operation of the train. When a locomotive 12 completes a trip, or otherwise stops on a track 26, image data stored either in the camera 14 or in the operating system 16 may be loaded to a wayside controller 36. In addition, data relative to the geographic coordinates for the wayside devices depicted in the images is provided. In an embodiment, multiple trains may be used wherein each train may be assigned designated track sections so that multiple trains may more record images for an entire railroad track system. As described above the database may be updated by marking data relative to the location and identity of wayside devices 28 as verified. Data relative to entire track sections may also be marked. In addition, the wayside devices 28 that are not accurately represented in the database may be flagged so that an operator can update the database accordingly. As discussed above the onboard controller 36 may be configured to comprise a location determiner algorithm by using data from various inputs such as the GPS transceiver, speed sensors, operator inputs or wayside sources. The controller 36 may also receive the image data or coordinate data, and compare the determined location for grade or wayside equipment to verify the accuracy of the database within in some predetermined range.

An embodiment of the invention may also take the form of a computer readable memory media for verifying data in a track database 18 for a track 26 on which a powered vehicle 12 may travel. The computer readable medium may comprise a computer module that provides a track profile database stored in a memory. The track profile database includes data 21 relative to the identity of one or more wayside devices 34 for the track and data relative to a location associated with each of the one or more wayside devices on the track 26. A computer module that interfaces with a camera that generates (typically in the form of a camera) onboard the vehicle 12, visible spectral data or other spectral data of the wayside equipment as the vehicle 12 travels on the track 12. In addition, a computer module stores the spectral data received from the camera 14 and for storing data relative to a location of the powered vehicle 12 when the spectral data of the wayside device 28 is generated. The location of the vehicle 12 represents the location of the wayside device 28. A computer module compares the location data of the one or more wayside devices 28 stored in the track database to the location data associated with the spectral data of the wayside devices stored in the data storage device to verify the accuracy of the wayside device 28 location data in the track database.

Embodiments of the invention may further comprise a computer module that records date and time information relative to the recorded spectral visible data (or other spectral data) for the one or more wayside devices. In addition, a computer module records the date and time information associated with the location data of the powered vehicle, and a computer module matches the date and time information of the powered vehicle to the date and time information for the recorded image to determine the location of the one or more wayside devices. In addition, or alternatively, the computer readable memory media further includes a computer module for calculating the distance the vehicle has traveled on the track relative to a fixed reference point to determine the location of the vehicle on the track; and, a computer module provides in the track database a distance the one or more wayside devices is relative to the fixed reference point. The system or computer software may be used with a plurality of powered vehicles wherein each vehicle is equipped with a camera. The spectral data and location data for the wayside devices may be recorded by all the vehicles to provide further verification of the track database.

Although embodiments of the invention have been described herein primarily in regards to locomotives, trains, and tracks, the invention more generally relates to vehicles traveling over a designated route. For example, one embodiment of the present invention relates to a system for verifying data in a database relating to a route on which a powered vehicle may travel. In this embodiment, the system includes a route profile database stored in a memory. The route profile database includes route profile data relating to one or more route grades of the route (e.g., rate of change of an elevation rise or fall over a designated length of the route) and, for each route grade, a location associated with the route grade. (The location may be a particular point, or a segment along the route.) In addition, the route profile data may include the identity and location of various wayside devices along the track. The powered vehicle is operated over the route according to the route profile data and, for each route grade, a planned vehicle operating condition associated with the route grade. (For example, for a given route grade at a location, the planned vehicle operating condition might be a throttle setting at which the vehicle is to be operated when it reaches the location.) The system also includes data storage device for storing data relative to the location of the vehicle and, for each location, data relative to a current operating condition of the vehicle at the location, as the vehicle travels on the route. (For example, at a first location of the vehicle, data relating to a current operating condition of the vehicle at the first location is stored; at a second location of the vehicle, data relating to the current operating condition of the vehicle at the second location is stored; and so on.) The current operating condition might be vehicle speed, for example. The system also includes a controller configured to compare the stored current vehicle operating condition of the vehicle and associated location to the planned vehicle operating condition to verify the accuracy of the route grade data at the associated location. Post processing of the track grade data and location of wayside equipment may be conducted quickly and efficiently by using multiple powered vehicles. For example, each powered vehicle may be assigned sections of a track and the stored data may be fast forward to more quickly locate the wayside equipment associated with a track section.

Embodiments described above may be implemented on a suitable computer system, controller, memory, or generally a computer readable medium. For example, the steps of the methods described above may correspond to computer instructions, logic, software code, or other computer modules disposed on the computer readable medium, e.g., floppy disc, hard drive, ASIC, remote storage, optical disc, or the like. The computer-implemented methods and/or computer code may be programmed into an electronic control unit of an engine, a main control system of the locomotive, a remote control station that communicates with the locomotive unit, or the like, as described above.

While various embodiments of the present invention have been shown and described herein, it will be obvious that such embodiments are provided by way of example only and not of limitation. Numerous variations, changes and substitutions will occur to those skilled in the art without departing from the teaching of the present invention. Accordingly, it is intended that the invention be interpreted within the full spirit and scope of the appended claims.

The invention claimed is:

1. A system comprising:

a camera configured to be disposed onboard a powered vehicle traveling along a track, the camera configured to acquire spectral data of one or more wayside devices disposed alongside the track as the powered vehicle travels on the track;

a location determining device configured to determine vehicle locations of the powered vehicle as the powered vehicle travels on the track;

a data storage device configured to store the spectral data acquired by the camera and first temporal information representative of when the spectral data is acquired, the data storage device also configured to store the vehicle locations of the powered vehicle and second temporal information representative of when the powered vehicle is at the vehicle locations; and a controller configured to compare the first temporal information associated with the spectral data with the second temporal information associated with the vehicle locations in order to determine where the spectral data is acquired along the track.

2. The system of claim 1, wherein the controller is configured to match the second temporal information associated with the vehicle locations of the powered vehicle to the first temporal information associated with the spectral data to determine one or more locations of the one or more wayside devices.

3. The system of claim 1, wherein the location determining device includes a global positioning system transceiver on the powered vehicle that is configured to transmit geographic data of the powered vehicle to the data storage device, the geographic data comprising at least part of the vehicle locations of the powered vehicle that are stored in the data storage device.

4. The system of claim 1, wherein the controller is configured to determine a distance that the powered vehicle travels on the track relative to a reference point to determine one or more of the vehicle locations of the powered vehicle on the track.

5. The system of claim 1, wherein the powered vehicle is a locomotive in a train and the one or more wayside devices include at least one of a track switch, a signal light, or a milepost.

6. The system of claim 1, wherein the powered vehicle is one powered vehicle of a plurality of powered vehicles, and the controller is configured compare the first temporal information associated with the spectral data acquired by two or more of the plurality of powered vehicles with the second temporal information associated with the vehicle locations of the two or more of the plurality of powered vehicles in order to determine locations of the one or more wayside devices that are imaged in the spectral data that is acquired by the two or more of the plurality of powered vehicles.

7. The system of claim 1, wherein the controller is configured to be positioned onboard the powered vehicle.

8. The system of claim 1, wherein the controller is configured to be positioned off board the powered vehicle.

9. The system of claim 1, wherein the data storage device is configured to store the vehicle locations of the powered vehicle on the track as longitude and latitude geographic coordinates of the powered vehicle.

10. The system of claim 1, wherein the controller is configured to determine one or more locations of the one or more wayside devices by comparing the first temporal information associated with the spectral data with the second temporal information associated with the locations of the powered vehicle, and the controller is configured to determine if the one or more locations of the one or more wayside devices are accurate by comparing the one or more locations of the one or more wayside devices with previously determined locations of the one or more wayside devices.

11. A method comprising:

aquiring, with a camera onboard a powered vehicle, spectral data of one or more wayside devices disposed alongside a track as the powered vehicle travels on the track;

storing, in a data storage device, the spectral data acquired by the camera and first temporal information indicative of when the spectral data is acquired;

determining one or more vehicle locations of the powered vehicle as the powered vehicle travels on the track and associated second temporal information indicative of when the powered vehicle is at the one or more vehicle location;

determining one or more potential locations of the one or more wayside devices of which the spectral data is acquired by comparing the first temporal information associated with the spectral data with the second temporal information associated with the one or more vehicle locations of the powered vehicle; and comparing with a controller the one or more potential locations of the one or more wayside devices with one or more stored locations of the one or more wayside devices that is stored in a track profile database to check an accuracy of the one or more stored locations of the one or more wayside device devices.

12. The method of claim 11, wherein determining the one or more potential locations of the at least one of the wayside devices includes matching the second temporal information of the powered vehicle to the first temporal information of the spectral data to determine where the spectral data is acquired.

13. The method of claim 11, wherein determining the one or more vehicle locations of the powered vehicle includes acquiring geographic coordinate data of the powered vehicle from a global positioning system transceiver disposed on the powered vehicle.

14. The method of claim 11, wherein determining the one or more vehicle locations of the powered vehicle includes calculating a distance that the powered vehicle travels on the track relative to a point.

15. The method of claim 11, wherein the powered vehicle is a locomotive in a train and the wayside device includes at least one of a track switch, a signal light, or a milepost.

16. The method of claim 11, wherein determining the one or more potential locations includes comparing the first temporal information associated with the spectral data that is acquired by a plurality of the powered vehicles with the second temporal information associated with the vehicle locations of the plurality of the powered vehicles.

17. The method of claim 11, wherein determining the one or more potential locations of the at least one of the wayside devices occurs onboard the powered vehicle.

18. The method of claim 11, wherein determining the one or more potential locations of the at least one of the wayside devices occurs off board the powered vehicle.

19. The method of claim 11, wherein the one or more vehicle locations of the powered vehicle includes a longitude and latitude geographic coordinate of the powered vehicle.

20. A system comprising:

a track profile database stored in a memory and having track profile data that includes one or more previously determined locations of one or more wayside devices disposed alongside a track;

a data storage device for storing spectral data associated with the one or more wayside devices and acquired from onboard a powered vehicle as the powered vehicle travels along the track, the data storage device also for storing data relative to first temporal information indicative of when the spectral data is acquired, a vehicle location of the powered vehicle, and second temporal information indicative of when the powered vehicle is at the vehicle location; and a controller configured to compare the first temporal information of the spectral data with the second temporal information of the vehicle location to determine one or more potential locations of the one or more wayside devices, and wherein the controller is configured to check an accuracy of the one or more previously determined locations of the one or more wayside devices by comparing the one or more previously determined locations with the one or more potential locations of the one or more wayside devices.

21. A method comprising:

recording spectral data of one or more wayside devices and first temporal information indicative of when the spectral data is recorded, the one or more wayside devices disposed alongside a route traveled by a powered vehicle as the powered vehicle travels on the track;

recording one or more vehicle locations of the powered vehicle as the powered vehicle travels along the track and second temporal information indicative of when the powered vehicle is at the one or more vehicle locations; and comparing with a controller the first temporal information of the spectral data to the second temporal information of the one or more vehicle locations of the powered vehicle to determine a location of the one or more wayside devices and to verify an accuracy of one or more previously determined locations of the one or more wayside devices.

22. A method comprising:

recording spectral data of a wayside device located alongside a track and first temporal information indicative of when the spectral data is recorded as a vehicle travels along the track;

recording location data relating to a location of the powered vehicle and second temporal information indicative of when the vehicle is at the location; and determining with a controller a potential location of the wayside device by comparing the first temporal information associated with the spectral data with the second temporal information associated with the location of the vehicle.

23. The method of claim 22, further comprising determining whether to change a previously designated location of the wayside device by comparing the previously designated location with the potential location of the wayside device.

24. A system comprising:

a controller configured to receive spectral data acquired by a camera disposed onboard a powered vehicle, the spectral data acquired of one or more wayside devices disposed alongside a route that is traveled by the powered vehicle as the vehicle moves along the route, the controller also configured to receive or determine first temporal information indicative of when the spectral data is acquired and to obtain one or more locations of the powered vehicle as the powered vehicle moves along the route and second temporal information indicative of when the powered vehicle is at the one or more locations, wherein the controller is configured to determine where the spectral data is acquired by comparing the first temporal information of the spectral data with the second temporal information of the one or more locations of the powered vehicle.

25. The system of claim 24, wherein the controller is configured to determine a potential location of the one or more wayside devices based on where the spectral data is acquired.

26. The system of claim 25, wherein the controller is configured to convey the potential location of the one or more wayside devices to a data storage device for verifying a previously determined location of the one or more wayside devices.

* * * * *

UNITED STATES PATENT AND TRADEMARK OFFICE

CERTIFICATE OF CORRECTION

PATENT NO. : 8,452,467 B2
APPLICATION NO. : 12/208516
DATED : May 28, 2013
INVENTOR(S) : Kumar It is certified that error appears in the above-identified patent and that said Letters Patent is hereby corrected as shown below:

On the Title Page, item (74), under "Attorney, Agent, or Firm", in Column 2, Line 1, delete "Operation" and insert -- Operation; John A. Kramer --, therefor.

In the Specifications:

In Column 5, Line 14, delete "locomotive 22" and insert -- locomotive 12 --, therefor.

In Column 5, Line 15, delete "track 16" and insert -- track 26 --, therefor.

In Column 5, Line 32, delete "track 16," and insert -- track 26, --, therefor.

In Column 5, Line 46, delete "track 16" and insert -- track 26 --, therefor.

In Column 7, Line 21, delete "controller 34" and insert -- controller 36 --, therefor.

In Column 7, Line 51, delete "devices 34" and insert -- devices 28 --, therefor.

In Column 7, Line 57, delete "track 12." and insert -- track 26. --, therefor.

In the Claims:

In Column 9, Line 62, in Claim 6, delete "configured compare" and insert -- configured to compare --, therefor.

In Column 10, Line 22, in Claim 11, delete "aquiring," and insert -- acquiring, --, therefor.

In Column 10, Line 32, in Claim 11, delete "location;" and insert -- locations; --, therefor.

Signed and Sealed this
Thirteenth Day of August, 2013

Teresa Stanek Rea

Teresa Stanek Rea
*Acting Director of the United States Patent and Trademark Office*

In Column 10, Line 44, in Claim 11, delete “device devices.” and insert -- devices. --, therefor.

In Column 10, Line 58, in Claim 14, delete “to a point.” and insert -- to a reference point. --, therefor.